US012049881B2

(12) United States Patent
Song et al.

(10) Patent No.: US 12,049,881 B2
(45) Date of Patent: Jul. 30, 2024

(54) SWASH PLATE COMPRESSOR

(71) Applicant: Hanon Systems, Daejeon (KR)

(72) Inventors: Se Young Song, Daejeon (KR); Ok Hyun Kim, Daejeon (KR); Kwang Jin Kim, Daejeon (KR); Dong Hyuk Chang, Daejeon (KR); Sung Myung Lee, Daejeon (KR); Ki Sang Hong, Daejeon (KR)

(73) Assignee: HANON SYSTEMS, Daejeon (KR)

( * ) Notice: Subject to any disclaimer, the term of this patent is extended or adjusted under 35 U.S.C. 154(b) by 29 days.

(21) Appl. No.: 17/999,952

(22) PCT Filed: May 10, 2021

(86) PCT No.: PCT/KR2021/005799

§ 371 (c)(1),
(2) Date: Nov. 28, 2022

(87) PCT Pub. No.: WO2021/241911

PCT Pub. Date: Dec. 2, 2021

(65) Prior Publication Data

US 2023/0204021 A1 Jun. 29, 2023

(30) Foreign Application Priority Data

May 27, 2020 (KR) ..... 10-2020-0063872

(51) Int. Cl.
*F04B 27/16* (2006.01)
*F04B 27/10* (2006.01)
*F04B 27/18* (2006.01)

(52) U.S. Cl.
CPC ..... *F04B 27/16* (2013.01); *F04B 27/10* (2013.01); *F04B 2027/1831* (2013.01);
(Continued)

(58) Field of Classification Search
CPC .. F04B 27/10; F04B 27/16; F04B 2027/1831; F04B 2027/1845; F04B 2027/1859;
(Continued)

(56) References Cited

U.S. PATENT DOCUMENTS

2003/0010048 A1* 1/2003 Murase ..... F04B 27/1804 62/228.5
2011/0214564 A1* 9/2011 Okuda ..... F04B 27/1081 91/505

FOREIGN PATENT DOCUMENTS

EP 2660469 A1 11/2013
JP 2006220048 A * 8/2006
(Continued)

OTHER PUBLICATIONS

JP-2006-220048 (Year: 2006).*

*Primary Examiner* — Devon C Kramer
*Assistant Examiner* — Joseph S. Herrmann
(74) *Attorney, Agent, or Firm* — Shumaker, Loop & Kendrick, LLP; James D. Miller

(57) ABSTRACT

A swash plate compressor including: a housing; a rotating shaft rotatably mounted to the housing; a swash plate accommodated in a crank chamber of the housing and rotating with the rotating shaft; a piston forming a compression chamber with the housing and interlocking with the swash plate to reciprocate; a discharge flow path guiding a refrigerant of the crank chamber to a suction chamber of the housing wherein an inclination angle of the swash plate is adjusted; and a discharge flow path control valve having a valve chamber provided in the discharge flow path and a valve core reciprocating inside the valve chamber, and the valve core includes: a first communication path constantly communicating the discharge flow path; and a second communication path communicating the discharge flow path
(Continued)

when differential pressure between pressure of the crank chamber and pressure of the suction chamber is within a certain pressure range.

11 Claims, 6 Drawing Sheets

(52) U.S. Cl.
CPC ..... *F04B 2027/1845* (2013.01); *F04B 2027/1859* (2013.01); *F04B 2027/1868* (2013.01); *F04B 2027/1881* (2013.01); *F04B 2027/1895* (2013.01)

(58) Field of Classification Search
CPC ..... F04B 2027/1868; F04B 2027/1881; F04B 2027/1895
See application file for complete search history.

(56) References Cited

FOREIGN PATENT DOCUMENTS

| | | | |
|---|---|---|---|
| JP | 2006220048 | A | 8/2006 |
| JP | 2014118922 | A | 6/2014 |
| KR | 20160041450 | A | 4/2016 |
| KR | 20200009554 | A | 1/2020 |

* cited by examiner

Fig. 1 - Prior Art

SWASH PLATE COMPRESSOR

CROSS REFERENCE TO RELATED PATENT APPLICATIONS

This is a U.S. national phase patent application of PCT/KR2021/005799 filed May 10, 2021 which claims the benefit of and priority to Korean Pat. Appl. No. 10 2020 0063872 filed on May 27, 2020, the entire contents of each of which are incorporated herein by reference.

TECHNICAL FIELD

The present disclosure relates to a swash plate compressor, and more particularly, to a swash plate compressor in which an inclination angle of the swash plate can be adjusted by adjusting pressure of a crank chamber to which the swash plate is provided.

BACKGROUND ART

In general, a compressor that compresses a refrigerant in a vehicle cooling system has been developed in various forms. Regarding configuration of compressing a refrigerant of such a compressor, there are a reciprocating type that performs compression while performing a reciprocating motion and a rotary type that performs compression while performing a rotational motion. In addition, in the reciprocating type, there are a crank type in which the driving force of the driving source is transferred to a plurality of pistons using a crank, a swash plate type in which the driving force of the driving source is transferred to a rotating shaft having a swash plate, and a wobble plate type using a wobble plate, and in the rotary type, there are a vane rotary type using a rotating rotary shaft and a vane, and a scroll type using an orbiting scroll and a fixed scroll.

Here, the swash plate compressor is a compressor that compresses a refrigerant by reciprocating a piston with a swash plate rotating together with a rotating shaft, and recently, in order to improve performance and efficiency of the compressor, the swash plate compressor is formed in the so-called variable capacity method in which a refrigerant discharge amount is controlled by adjusting a stroke of a piston through adjustment of an inclination angle of the swash plate. FIG. 1 is a perspective view illustrating a conventional swash plate compressor formed in a variable capacity method.

Referring to FIG. 1, the conventional swash plate compressor includes a housing 100 having a bore 114, a suction chamber S1, a discharge chamber S3 and a crank chamber S4, a rotating shaft 210 that is rotatably supported on the housing 100, a swash plate 220 that is interlocked with the rotating shaft 210 to rotate inside a crank chamber S4, and a piston 230 that is interlocked with the swash plate 220, reciprocates in an inside of the bore 114 and forms a compression chamber together with the bore 114, a valve mechanism 300 through which the suction chamber S1 and the discharge chamber S3 communicate with and shield the compression chamber, and an inclination adjustment mechanism 400 for adjusting an inclination angle of the swash plate 220 with respect to the rotating shaft 210.

The inclination adjustment mechanism 400 includes an inflow path 430 for guiding a refrigerant in the discharge chamber S3 to the crank chamber S4 and a discharge flow path 450 for guiding a refrigerant in the crank chamber S4 to the suction chamber S1.

A pressure control valve (not illustrated) for controlling an amount of a refrigerant flowing from the discharge chamber S3 into the inflow path 430 is formed in the inflow path 430.

An orifice hole H for depressurizing a fluid passing through the discharge flow path 450 is formed in the discharge flow path 450.

In the conventional swash plate compressor according to this configuration, when power is transferred to the rotating shaft 210 from a driving source (not illustrated) (e.g., an engine of a vehicle), the rotating shaft 210 and the swash plate 220 are rotated together.

In addition, the piston 230 converts the rotational motion of the swash plate 220 into a linear motion to reciprocate inside the bore 114.

In addition, when the piston 230 moves from a top dead center to a bottom dead center, the compression chamber is communicated with the suction chamber S1 and is shielded from the discharge chamber S3 through the valve mechanism 300, and a refrigerant of the suction chamber S1 is sucked into the compression chamber.

Further, when the piston 230 moves from a bottom dead center to a top dead center, the compression chamber is shielded from the suction chamber S1 and the discharge chamber S3 through the valve mechanism 300, and a refrigerant of the compression chamber is compressed.

In addition, when the piston 230 reaches a top dead center, the compression chamber is shielded from the suction chamber S1 and communicated with the discharge chamber S3 through the valve mechanism 300, the refrigerant compressed in the compression chamber is discharged to the discharge chamber S3.

Here, in the conventional swash plate compressor, an amount of a refrigerant flowing into the inflow path 430 from the discharge chamber S3 is adjusted by the pressure control valve (not illustrated) according to the required refrigerant discharge amount such that a pressure of the crank chamber S4 is adjusted, a stroke of the piston 230 is adjusted, an inclination angle of the swash plate 220 is adjusted, and the refrigerant discharge amount is adjusted.

Specifically, when a sum of a moment of the swash plate 220 by a pressure of the crank chamber S4 and a moment by return spring of the swash plate 220 (hereinafter, a first moment) is greater than a moment by compression reactive force of the piston 230 (hereinafter, a second moment), an inclination angle of the swash plate 220 is decreased, and in a case opposite thereto, the inclination angle of the swash plate 220 is increased.

However, when an amount of a refrigerant flowing into the inflow path 430 from the discharge chamber S3 is increased by the pressure control valve (not illustrated) and an amount of a refrigerant introduced into the crank chamber S4 through the inflow path 430 is increased, a pressure in the crank chamber S4 is increased and the first moment is increased.

Here, the refrigerant of the crank chamber S4 is discharged to the suction chamber S1 through the discharge flow path 450, but when an amount of a refrigerant from the discharge chamber S3 introduced to the suction chamber S1 through the inflow path 430 is greater than an amount of a refrigerant flowing from the crank chamber S4 through the discharge flow path 450 to the suction chamber S1, a pressure in the crank chamber S4 is increased.

In addition, when the first moment is greater than the second moment, the inclination angle of the swash plate 220 is decreased, the stroke of the piston 230 is decreased, and the refrigerant discharge amount is decreased.

On the other hand, when an amount of a refrigerant flowing into the inflow path 430 from the discharge chamber S3 is decreased by the pressure control valve (not illustrated) and an amount of a refrigerant introduced into the crank chamber S4 through the inflow path 430 is decreased, the pressure in the crank chamber S4 is decreased, and the first moment is decreased.

Here, even if a refrigerant in the discharge chamber S3 flows into the crank chamber S4 through the inflow path 430, when an amount of a refrigerant discharged from the crank chamber S4 through the discharge flow path 450 to the suction chamber S1 is greater than an amount of a refrigerant flowing from the discharge chamber S3 through the inflow path 430 and introduced to the crank chamber S4, the pressure in the crank chamber S4 is decreased.

In addition, when the first moment gets smaller than the second moment, the inclination angle of the swash plate 220 is increased, the stroke of the piston 230 is increased, and the refrigerant discharge amount is increased.

On the other hand, when the first moment and the second moment are the same, the inclination angle of the swash plate 220 is maintained in a steady state, and the stroke of the piston 230 and the refrigerant discharge amount are kept constant.

Here, since the compression reactive force of the piston 230 is proportional to a compression amount, the compression reactive force and the second moment of the piston 230 increase as the inclination angle of the swash plate 220 increases. Accordingly, as the inclination angle of the swash plate 220 increases, the pressure in the crank chamber S4 for maintaining the inclination angle of the swash plate 220 also increases. That is, the pressure in the crank chamber S4 when the inclination angle of the swash plate 220 is relatively large but maintained in a steady state is required to be greater than the pressure in the crank chamber S4 when the inclination angle of the swash plate 220 is relatively small but maintained in a steady state.

On the other hand, when the refrigerant in the crank chamber S4 flows into the suction chamber S1 through the discharge flow path 450, as the pressure is reduced to the suction pressure level by the orifice hole H, the pressure in the suction chamber S1 is prevented from being increased.

However, regarding the conventional swash plate compressor, there is a problem in that it is impossible to promptly control a refrigerant discharge amount while at the same time preventing a decrease in compressor efficiency.

Specifically, as described above, the crank chamber S4 communicates with the suction chamber S1 through the discharge flow path 450 in order to increase the refrigerant discharge amount by reducing pressure in the crank chamber S4. Moreover, in general, a cross-sectional area of the orifice hole H of the discharge flow path 450 is formed to the maximum possible in order to improve responsiveness to an increase in a refrigerant discharge amount. That is, the orifice hole H is formed as a fixed orifice hole H, and a cross-sectional area of the orifice hole H is formed to the maximum within a range that sufficiently depressurizes a refrigerant passing through the discharge flow path 450, such that the refrigerant in the crank chamber S4 is rapidly discharged to the suction chamber S1, the pressure in the crank chamber S4 is rapidly reduced, the stroke of the piston 230 is rapidly increased, and the inclination angle of the swash plate 220 is rapidly increased, thereby the refrigerant discharge amount is rapidly increased. However, when the cross-sectional area of the orifice hole H is formed as large as possible, an amount of a refrigerant leaked from the crank chamber S4 to the suction chamber S1 is substantial. Accordingly, in a minimum mode or a variable mode (a mode in which a refrigerant discharge amount is increased, maintained, or decreased between the minimum mode and a maximum mode), in order to adjust the pressure of the crank chamber S4 to a desired level, an amount of a refrigerant flowing into the crank chamber S4 from the discharge chamber S3 through the inflow path 430 should be increased compared to that of a case in which a cross-sectional area of the orifice hole H is formed relatively small. Accordingly, since the amount of a refrigerant discharged to a cooling cycle among compressed refrigerants is reduced, in order to achieve a desired cooling or heating level, power input to the compressor should be increased such that the compressor compresses more refrigerant, and compressor efficiency is reduced.

In addition, there was a problem in that responsiveness at the initial stage of driving deteriorated. That is, even if the cross-sectional area of the orifice hole H was formed to the maximum within a range that sufficiently depressurizes the refrigerant passing through the discharge flow path 450, there was a limit for the refrigerant of the crank chamber S4 in being discharged rapidly to the suction chamber S1, thus it was a problem in that time required for switching to the maximum mode at the initial stage of driving increased. In addition, a liquid refrigerant may be present in the crank chamber S4 before driving, and it was a problem that time required for switching to the maximum mode was further increased as the liquid refrigerant was clogged in the orifice hole H.

SUMMARY

Accordingly, an object of the present disclosure is to provide a swash plate compressor capable of rapidly controlling a refrigerant discharge amount while at the same time preventing efficiency decrease of the compressor.

Another object of the present disclosure is to provide a swash plate compressor capable of improving responsiveness at the initial stage of driving.

One embodiment is a swash plate compressor including: a housing; a rotating shaft rotatably mounted to the housing; a swash plate accommodated in a crank chamber of the housing and rotating together with the rotating shaft; a piston forming a compression chamber together with the housing and interlocking with the swash plate to reciprocate; a discharge flow path for guiding a refrigerant of the crank chamber to a suction chamber of the housing such that an inclination angle of the swash plate is adjusted; and a discharge flow path control valve having a valve chamber provided in the discharge flow path and a valve core reciprocating inside the valve chamber, and the valve core may include a first communication path for constantly communicating the discharge flow path, and a second communication path for communicating the discharge flow path when differential pressure between pressure of the crank chamber and pressure of the suction chamber is within a certain pressure range.

The discharge flow path control valve may further include: a valve inlet through which the crank chamber communicates with the valve chamber; a valve outlet through which the suction chamber communicates with the valve chamber; and an elastic member for pressing the valve core toward the valve inlet.

The valve chamber may include: an inlet portion communicating with the valve inlet; and an outlet portion communicating with the valve outlet, and an inner diameter of the inlet portion may be formed greater than an inner diameter of the outlet portion to form a second stepped surface between the inlet portion and the outlet portion.

The valve core may include: a base plate having a first pressure surface opposite to the valve inlet and a second pressure surface opposite to the valve outlet; and a side plate protruding annularly from an outer periphery of the second pressure surface, and the first communication path may be formed through the base plate from the first pressure surface to the second pressure surface, and the second communication path may be formed by through the side plate from an outer peripheral surface of the side plate to an inner peripheral surface of the side plate.

When a direction of a reciprocating motion of the valve core is an axial direction, the second communication path may be formed to extend in the axial direction.

An inner diameter of the valve inlet may be formed smaller than an outer diameter of the valve core, so that a first stepped surface contactable with the first pressure surface is formed between the inlet portion and the valve inlet, and an inner diameter of the valve outlet may be formed smaller than an outer diameter of the valve core, so that a third stepped surface contactable with a front-end surface of the side plate may be formed between the outlet portion and the valve outlet.

The elastic member may be formed as a coil spring having one end supported by the second pressure surface and the other end supported by the third stepped surface.

An inner diameter of the first communication path is formed smaller than an inner diameter of the valve inlet.

In the second communication path, when a portion furthest apart in an axial direction from a front-end surface of the side plate is a starting portion of the second communication path, an axial distance between the front-end surface of the side plate and the starting portion of the second communication path may be formed smaller than an axial length of the outlet portion, and an axial distance between the first pressure surface of the base plate and the starting portion of the second communication path may be formed smaller than an axial length of the inlet portion.

When the differential pressure is equal to or less than the first pressure, the first pressure surface may be in contact with the first stepped surface, and a refrigerant in the crank chamber may be moved to the suction chamber through the valve inlet, the first communication path, and the valve outlet, when the differential pressure is greater than the first pressure and less than the second pressure, the first pressure surface may be spaced apart from the first stepped surface, and at least a portion of the second communication path may be opened by an inner peripheral surface of the inlet portion, and the refrigerant in the crank chamber may be moved to the suction chamber through the valve inlet, the inlet portion, the first communication path, the second communication path, and the valve outlet; and when the differential pressure is equal to or greater than the second pressure, the first pressure surface may be spaced apart from the first stepped surface, and the second communication path may be closed by an inner peripheral surface of the outlet portion, and the refrigerant in the crank chamber may be moved to the suction chamber through the valve inlet, the inlet portion, the first communication path and the valve outlet.

The housing may include: a cylinder block having a bore accommodating the piston therein, a front housing coupled to one side of the cylinder block and having the crank chamber; and a rear housing coupled to another side of the cylinder block and having the suction chamber, and a valve mechanism through which the suction chamber communicates with and shields the suction chamber and the compression chamber may be interposed between the cylinder block and the rear housing; the rear housing may include a post portion supported by the valve mechanism; the valve inlet may be formed in the valve mechanism; and the valve outlet and the valve chamber may be formed in the post portion.

The discharge flow control valve may be formed to adjust a cross-sectional flow area of the discharge flow path to be equal to a first area when the differential pressure is equal to or less than the first pressure or equal to or greater than a second pressure, and be formed to adjust a cross-sectional flow area of the discharge flow path to be greater than the first area when the differential pressure is greater than the first pressure and less than the second pressure.

The discharge flow path control valve may be formed to decrease a cross-sectional flow area of the discharge flow path accordingly, as the differential pressure increases within a range greater than the first pressure and smaller than the second pressure.

A swash plate compressor according to the present disclosure includes: a housing; a rotating shaft rotatably mounted to the housing; a swash plate accommodated in a crank chamber of the housing and rotating together with the rotating shaft; a piston forming a compression chamber together with the housing and interlocking with the swash plate to reciprocate; a discharge flow path for guiding a refrigerant of the crank chamber to a suction chamber of the housing such that an inclination angle of the swash plate is adjusted; and a discharge flow path control valve having a valve chamber provided in the discharge flow path and a valve core reciprocating inside the valve chamber, and the valve core includes: a first communication path for constantly communicating the discharge flow path; and a second communication path for communicating the discharge flow path when differential pressure between pressure of the crank chamber and pressure of the suction chamber is within a certain pressure range. Accordingly, it becomes possible to rapidly control a refrigerant discharge amount while at the same time preventing a decrease in compressor efficiency, and improve responsiveness at the initial stage of driving.

DESCRIPTION OF AN EMBODIMENT

Hereinafter, a swash plate compressor according to the present disclosure will be described in detail with reference to the accompanying drawings.

Figure 1:
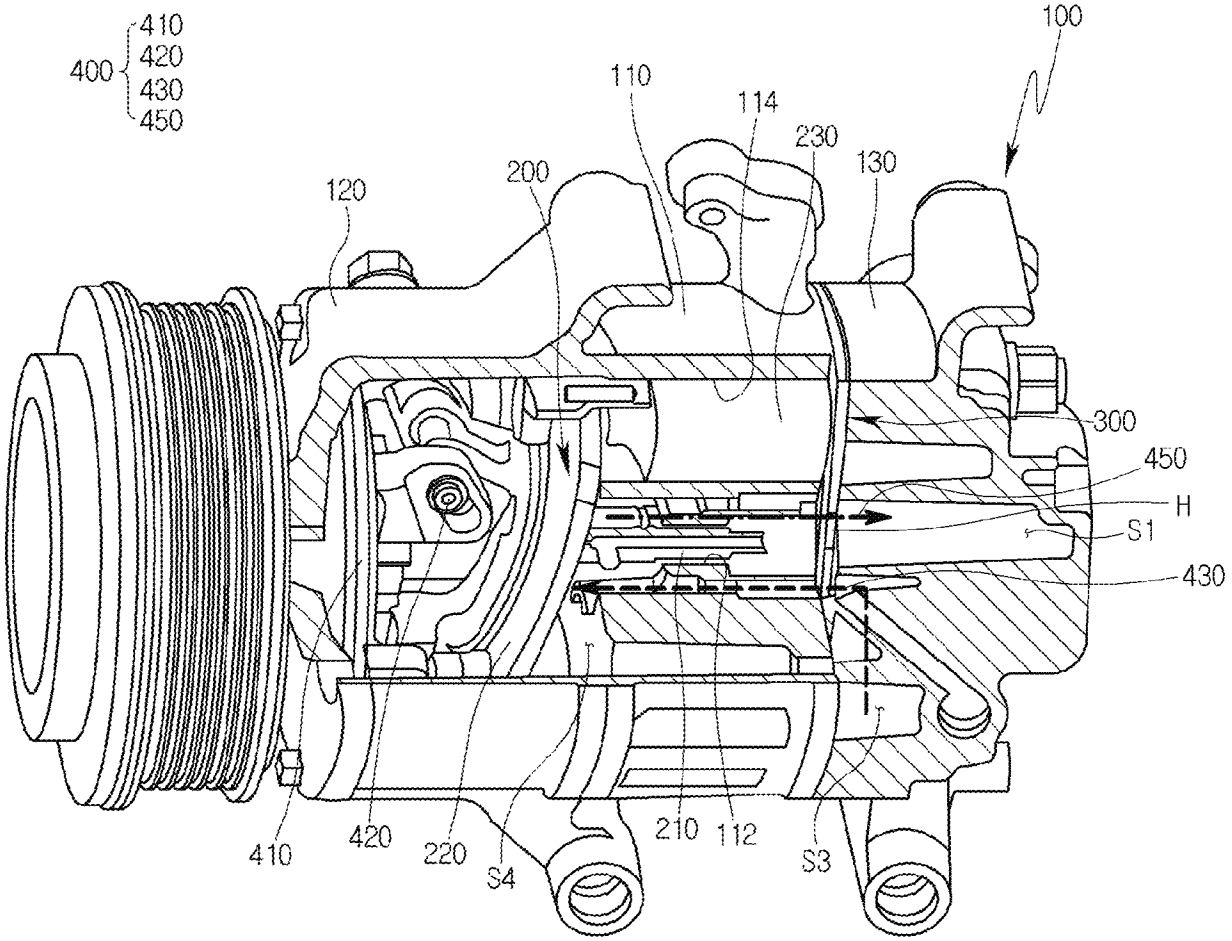
FIG. 1 is a perspective view illustrating a conventional swash plate compressor.
Figure 2:
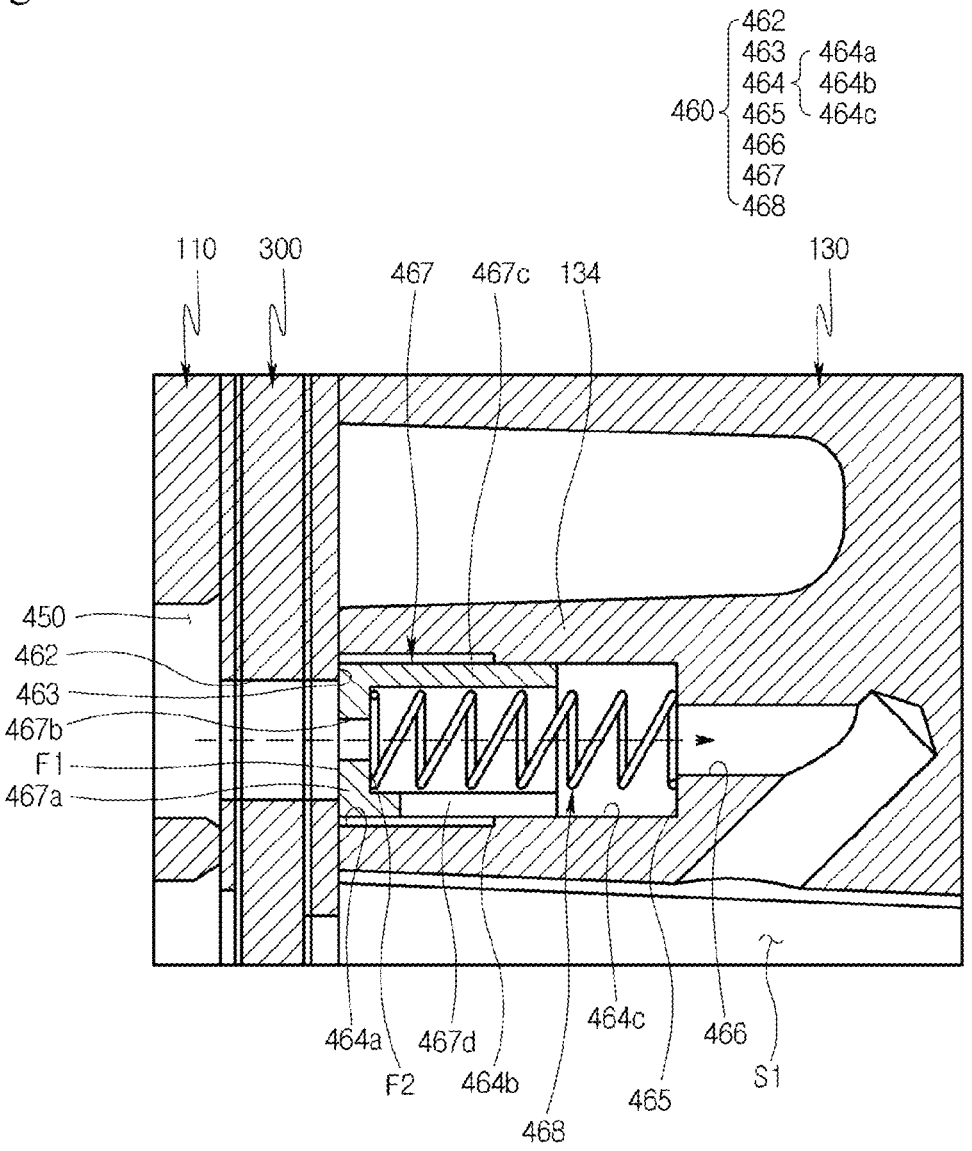
FIG. 2 is a cross-sectional view illustrating a discharge flow path in a swash plate compressor according to an embodiment of the present disclosure, in which differential pressure is equal to or less than the first pressure.
Figure 3:
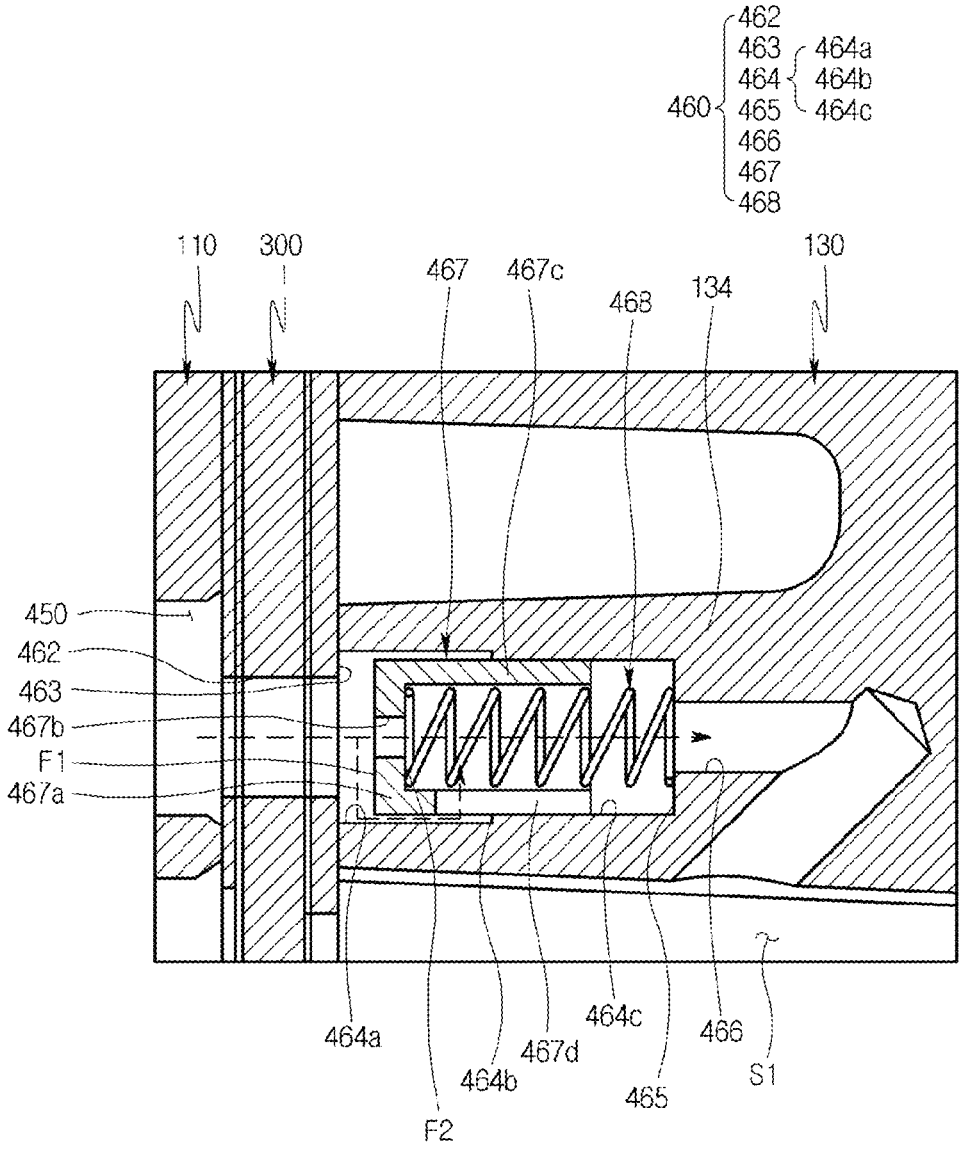
FIG. 3 is a cross-sectional view illustrating the discharge flow path in the swash plate compressor of FIG. 2, in which differential pressure is greater than the first pressure and smaller than the second pressure.
Figure 4:
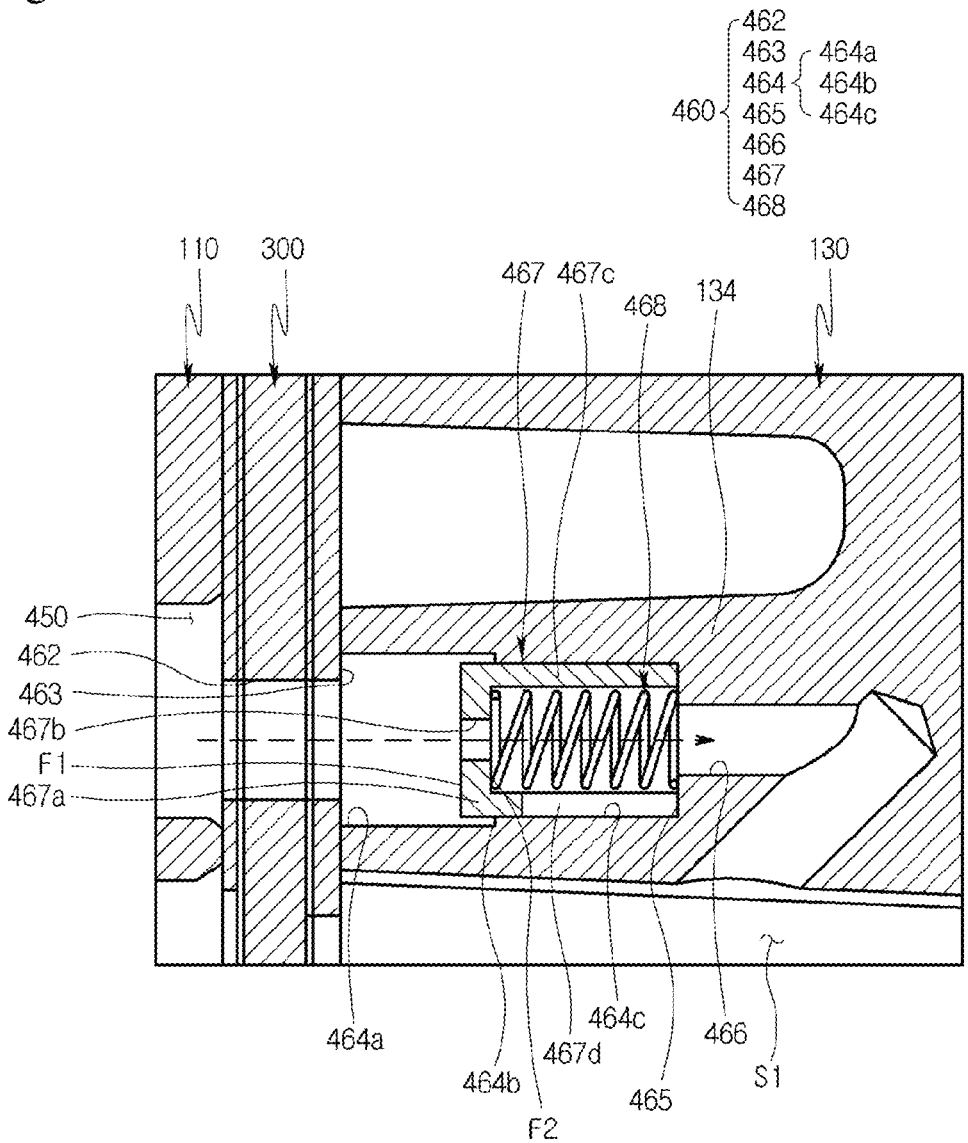
FIG. 4 is a cross-sectional view illustrating the discharge flow path in the swash plate compressor of FIG. 2, in which differential pressure is equal to or greater than the second pressure.
Figure 5:
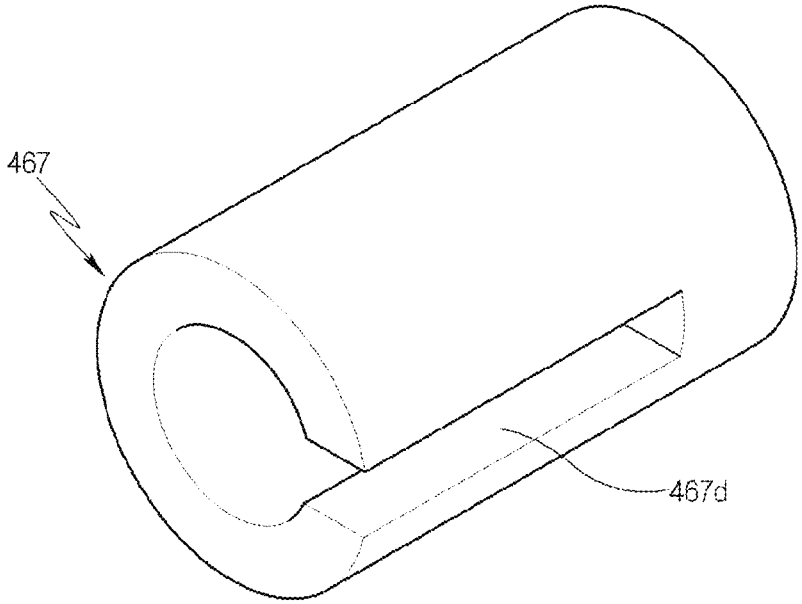
FIG. 5 is a perspective view illustrating the valve core of the discharge flow control valve in the swash plate compressor of FIG. 2.
Figure 6:
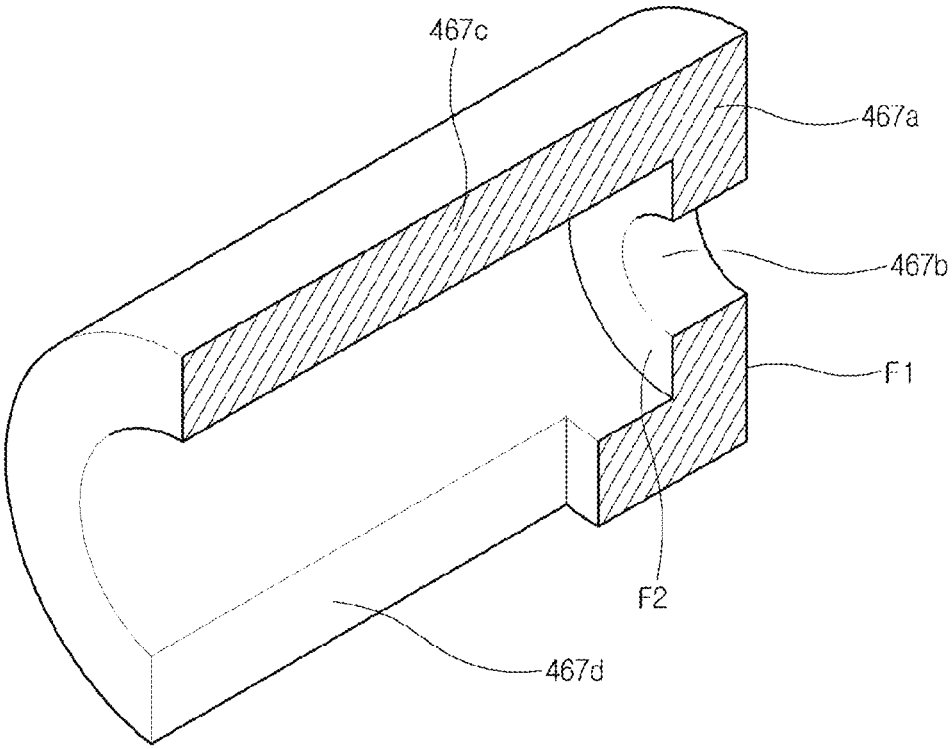
FIG. 6 is a cutaway perspective view illustrating the valve core of FIG. 5.
Figure 7:
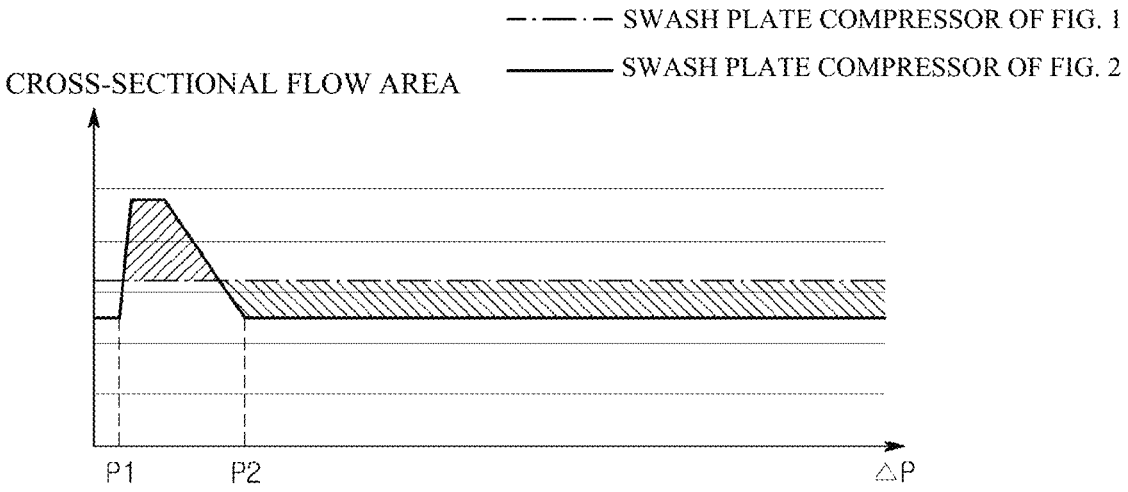
FIG. 7 is a graph illustrating comparison between differential pressure and the cross-sectional flow area of the discharge flow path in the swash plate compressor of FIGS. 1 and 2.
Figure 8:
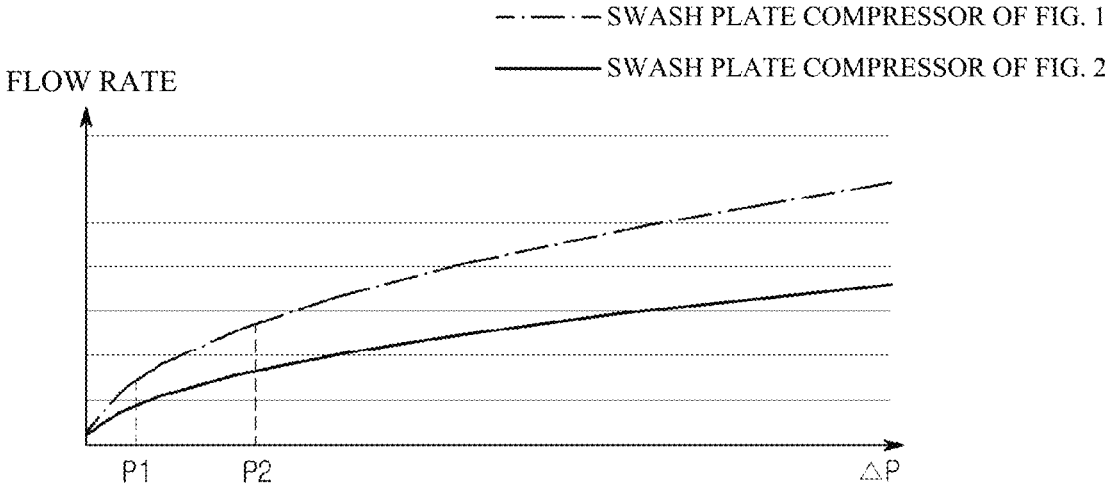
FIG. 8 is a graph illustrating comparison between differential pressure and a flow amount of the discharge flow path in the swash plate compressor of FIGS. 1 and 2.

FIG. 2 is a cross-sectional view illustrating a discharge flow path in a swash plate compressor according to an embodiment of the present disclosure, in which differential pressure is equal to or less than the first pressure, FIG. 3 is a cross-sectional view illustrating the discharge flow path in the swash plate compressor of FIG. 2, in which differential pressure is greater than the first pressure and smaller than the second pressure, FIG. 4 is a cross-sectional view illustrating the discharge flow path in the swash plate compressor of FIG. 2, in which differential pressure is equal to or greater than the second pressure, FIG. 5 is a perspective view illustrating the valve core of the discharge flow control valve in the swash plate compressor of FIG. 2, FIG. 6 is a cutaway perspective view illustrating the valve core of FIG. 5, FIG. 7 is a graph illustrating comparison between differential pressure and the cross-sectional flow area of the discharge flow path in the swash plate compressor of FIGS. 1 and 2, and FIG. 8 is a graph illustrating comparison between differential pressure and a flow amount of the discharge flow path in the swash plate compressor of FIGS. 1 and 2.

On the other hand, FIG. 1 should be referred to for components not illustrated in FIGS. 2 to 8 for convenience of description.

Referring to FIGS. 2 to 8 and 1, the swash plate compressor according to an embodiment of the present disclosure may include a housing 100, a compression mechanism 200 provided in the housing 100 and compressing a refrigerant.

The housing 100 may include a cylinder block 110 in which the compression mechanism 200 is accommodated, a front housing 120 coupled to a front of the cylinder block 110, and a rear housing 130 coupled to a rear of the cylinder block 110.

A bearing hole 112 into which a rotating shaft 210 to be described later is inserted is formed in a center of the cylinder block 110, and the piston 230 to be described later may be inserted into an outer periphery of the cylinder block 110 and the bore 114 constituting the compression chamber together with the piston 230 may be formed therein.

The front housing 120 may be coupled to the cylinder block 110 to form a crank chamber S4 in which a swash plate 220 to be described later is accommodated.

The rear housing 130 may include a suction chamber S1 in which a refrigerant flowing into the compression chamber is accommodated and a discharge chamber S3 in which a refrigerant discharged from the compression chamber is accommodated.

In addition, the rear housing 130 includes a post portion 134 extending from an inner wall surface of the rear housing 130 and supported by a valve mechanism to be described later so as to prevent deformation of the rear housing 130, and a portion of a discharge flow path 450 to be described later may be formed in the post portion 134.

The compression mechanism 200 may include the rotating shaft 210 that is rotatably supported by the housing 100 and is rotated by receiving rotational force from a driving source (e.g., an engine of a vehicle) (not illustrated), the swash plate 220 that is interlocked with the crank chamber S4 and rotates inside the crank chamber S4, and the piston 230 that is interlocked with the swash plate 220 and reciprocates inside the bore 114.

One end of the rotating shaft 210 may be inserted into the bearing hole 112 to be rotatably supported thereon, and the other end thereof may protrude outwards from the housing 100 through the front housing 120 and may be connected to the driving source (not illustrated).

The swash plate 220 may be formed in a disk shape, and may be obliquely fastened to the rotating shaft 210 in the crank chamber S4. Here, the swash plate 220 is fastened to the rotating shaft 210 in a way the inclination angle of the swash plate 220 becomes variable, which will be described later.

The piston 230 may include one end inserted into the bore 114 and the other end extending from the one end to an opposite side of the bore 114 and connected to the swash plate 220 from the crank chamber S4.

In addition, the swash plate compressor according to the present embodiment may further include the valve mechanism 300 that is interposed between the cylinder block 110 and the rear housing 130 and through which the suction chamber S1 and the discharge chamber S3 communicate with and shield the compression chamber.

In addition, the swash plate compressor according to the present embodiment may further include an inclination adjustment mechanism 400 for adjusting the inclination angle of the swash plate 220 with respect to the rotating shaft 210.

The inclination adjustment mechanism 400 may include a rotor 410 fastened to the rotating shaft 210 and rotating together with the rotating shaft 210 and a sliding pin 420 connecting the swash plate 220 and the rotor 410 such that the swash plate 220 is fastened to the rotating shaft 210 with the inclination angle of the swash plate 220 becoming available to vary.

In addition, the inclination adjusting mechanism 400 may include an inflow path 430 for guiding a refrigerant in the discharge chamber S3 to the crank chamber S4, and the discharge flow path 450 for guiding a refrigerant in the crank chamber S4 to the suction chamber S1 so as to adjust the inclination angle of the swash plate 220 by adjusting pressure in the crank chamber S4.

The inflow path 430 may extend from the discharge chamber S3 to the crank chamber S4 through the rear housing 130, the valve mechanism 300, and the cylinder block 110.

In addition, in the inflow path 430, the pressure control valve (not illustrated) for controlling an amount of a refrigerant flowing from the discharge chamber S3 into the inflow path 430 is formed, and the pressure control valve (not illustrated) may be formed as a so-called mechanical valve (MCV) or an electromagnetic valve (ECV).

The discharge flow path 450 may extend from the crank chamber S4 to the suction chamber S1 through the cylinder block 110 and the valve mechanism 300.

In addition, in the discharge flow path 450, a discharge flow path control valve 460 for controlling the cross-sectional flow area of the discharge flow path 450 by differential pressure $\Delta P$ between the pressure of the crank chamber S4 and the pressure of the suction chamber S1 460 may be formed.

The discharge flow control valve 460 may be formed to adjust the cross-sectional flow area of the discharge flow path 450 to be equal to a first area (cross-sectional area of a first communication path 467*b* to be described later) when differential pressure $\Delta P$ is equal to or less than the first pressure P1 or greater than the second pressure P2 which is greater than the first pressure P1, and to adjust the cross-sectional flow area of the discharge flow path 450 to become larger than the first area when the differential pressure ΔP is greater than the first pressure P1 and less than the second pressure P2.

In addition, the discharge flow control valve 460 may be formed such that as the differential pressure ΔP increases within a range where the differential pressure ΔP is greater than the first pressure P1 and less than the second pressure P2, the cross-sectional flow area of the discharge flow path 450 is decreased.

Specifically, the discharge flow control valve 460 may include a valve inlet 462 communicating with the crank chamber S4, a valve outlet 466 communicating with the suction chamber S1, a valve chamber 464 formed between the valve inlet 462 and the valve outlet 466, a valve core 467 reciprocating inside the valve chamber 464, and an elastic member 468 that presses the valve core 467 toward the valve inlet 462.

The valve inlet 462 may be formed in the valve mechanism 300, and the valve outlet 466 and the valve chamber 464 may be formed in the post portion 134 of the rear housing 130. Here, the discharge flow path control valve 460 according to the present embodiment does not include a separate valve casing to cut cost. That is, the valve inlet 462 is formed in the valve mechanism 300, and the valve outlet 466 and the valve chamber 464 are formed in the post portion 134. However, the present disclosure is not limited thereto, and the discharge flow path control valve 460 may include a separate valve casing, and the valve inlet 462, the valve outlet 466 and the valve chamber 464 may be formed in the valve casing.

The valve chamber 464 may include an inlet portion 464*a* communicating with the valve inlet 462 and an outlet portion 464*c* communicating with the valve outlet 466.

An inner diameter of the inlet portion 464*a* may be formed greater than an inner diameter of the valve inlet 462 such that the valve core 467 is not inserted into the valve inlet 462. That is, a first stepped surface 463 contactable with a first pressure surface F1 to be described later may be formed between the inlet portion 464*a* and the valve inlet 462.

In addition, an inner diameter of the inlet portion 464*a* may be formed greater than an inner diameter of the outlet portion 464*c* such that a portion of the refrigerant in the valve inlet 462 can be introduced between the valve core 467 and the inlet portion 464*a*, and a second stepped surface 464*b* may be formed between the inlet portion 464*a* and the outlet portion 464*c*.

In addition, when it comes to the inlet portion 464*a*, an axial length of the inlet portion 464*a* may be formed shorter than an axial length of the valve core 467 such that the valve core 467 is not completely separated from the outlet portion 464*c*.

In addition, an axial length of the inlet portion 464*a* may be formed greater than an axial distance between a first pressure surface F1 to be described later and a starting portion of a second communication path 467*d* to be described later such that the second communication path 467*d*, which will be described later, is opened by the inlet portion 464*a* when the valve core 467 is moved toward the valve inlet 462.

An inner diameter of the outlet portion 464*c* may be formed greater than an inner diameter of the valve outlet 466 such that the valve core 467 is not inserted into the valve outlet 466. That is, a third stepped surface 465 contactable with a front-end surface of a side plate 467*c* to be described later may be formed between the outlet portion 464*c* and the valve outlet 466.

An inner diameter of the outlet portion 464*c* may be formed at an equal level to (same or slightly greater) an outer diameter of the valve core 467 (more precisely, an outer diameter of a base plate 467*a* to be described later and the side plate 467*c* to be described later) and at a level equivalent to (same or slightly larger) the outlet portion 464*c* such that the valve core 467 can reciprocate inside the outlet portion 464*c* and a refrigerant between the valve core 467 and the inlet portion 464*a* can flow to the valve outlet 466 only through the second communication path 467*d* to be described later, in other words, a refrigerant between the valve core 467 and the inlet portion 464*a* can be prevented from flowing to the second communication path 467*d* through a path between the valve core 467 and the outlet portion 464*c*.

In addition, in the outlet portion 464*c*, an axial length of the outlet portion 464*c* may be formed greater than an axial distance from the front-end surface of the side plate 467*c* to be described later to the starting portion of the second communication path 467*d* (a part farthest apart in an axial direction from the front end of side plate 467*c*) such that the second communication path 467*d*, which will be described later, is gradually reduced and then closed by the outlet portion 464*c* when the valve core 467 is moved toward the valve outlet 466.

Further, in the outlet portion 464*c*, an axial length of the outlet portion 464*c* may be formed shorter than an axial length of the valve core 467 such that the valve core 467 is not completely inserted into the outlet portion 464*c*.

The valve core 467 may include a base plate 467*a* having a first pressure surface F1 opposite to the valve inlet 462 and a second pressure surface F2 opposite to the valve outlet 466, the side plate 467*c* protruding annularly from an outer periphery of the second pressure surface F2, and a first communication path 467*b* passing through the base plate 467*a* from the first pressure surface F1 to the second pressure surface F2 and a second communication path 467*d* passing through the side plate 467*c* from an outer peripheral surface of the side plate 467*c* to an inner peripheral surface of the side plate 467*c*.

The elastic member 468 may be formed as a coil spring having one end supported on the second pressure surface F2 and the other end supported on the third stepped surface 465 such that elastic member 468 can yield an effect similar to that of the second communication path 467*d* (the effect of reducing the cross-sectional flow area of the discharge flow path 450 accordingly as the valve core 467 moves toward the valve outlet 466).

Here, an inlet of the first communication path 467*b* is formed to face the valve inlet 462, and an outlet of the first communication path 467*b* may be formed to face an inside of the elastic member 468 (more precisely, a coil spring) such that a refrigerant flowing through the first communication path 467*b* to the valve outlet 466 is not obstructed by the elastic member 468.

In addition, an inner diameter of the first communication path 467*b* may be formed smaller than an inner diameter of the valve inlet 462 such that the first pressure surface F1 can come in under pressure by a refrigerant of the valve inlet 462 even in a state in which the first pressure surface F1 is in contact with the first stepped surface 463.

In addition, the second communication path 467*d* may be formed as a long hole extending in a reciprocating direction (axial direction) of the valve core 467 such that a cross-sectional flow area of the second communication path 467*d* decreases accordingly as the valve core 467 is moved toward the valve outlet 466.

In addition, the second communication path 467*d* may be formed outside the elastic member 468 (more precisely, a coil spring), and the valve outlet 466 may be formed to face an inside of the elastic member 468 (more precisely, a coil spring) such that a refrigerant flowing to the valve outlet 466 through the second communication path 467*d* is obstructed by the elastic member 468, in particular, a refrigerant flowing to the valve outlet 466 through the second communication path 467*d* is more obstructed by the elastic member 468 as the valve core 467 is moved toward the valve outlet 466.

Hereinafter, an operational effect of the swash plate compressor according to the present embodiment will be described.

That is, when power is transferred to the rotating shaft 210 from the driving source (not illustrated), the rotating shaft 210 and the swash plate 220 may be rotated together.

In addition, the piston 230 may be reciprocated inside the bore 114 by converting a rotational motion of the swash plate 220 into a linear motion.

In addition, when the piston 230 moves from a top dead center to a bottom dead center, the compression chamber communicates with the suction chamber S1 through the valve mechanism 300 and is shielded from the discharge chamber S3, and a refrigerant in the suction chamber S1 may be sucked into the compression chamber.

In addition, when the piston 230 moves from a bottom dead center to a top dead center, the compression chamber is shielded from the suction chamber S1 and the discharge chamber S3 by the valve mechanism 300, and a refrigerant in the compression chamber can be compressed.

In addition, when the piston 230 reaches a top dead center, the compression chamber is shielded from the suction chamber S1 and communicates with the discharge chamber S3 through the valve mechanism 300, a refrigerant compressed in the compression chamber may be discharged to the discharge chamber S3.

Here, in the swash plate compressor according to the present embodiment, the refrigerant discharge amount may be adjusted as follows.

That is, first, at the time of shutdown, the refrigerant discharge amount may be set to the minimum mode where the refrigerant discharge amount is minimal. That is, the swash plate 220 may be disposed closer to be vertical to the rotating shaft 210, accordingly the inclination angle of the swash plate 220 may be close to zero. Here, the inclination angle of the swash plate 220 may be measured as an angle between the rotating shaft 210 of the swash plate 220 and a normal line of the swash plate 220 with respect to a rotation center of the swash plate 220.

Next, once the operation is started, the refrigerant discharge amount may be adjusted to the maximum mode where the refrigerant discharge amount is maximal. That is, the inflow path 430 may be closed by the pressure control valve (not illustrated), and the pressure in the crank chamber S4 may be reduced to a suction pressure level. That is, the pressure of the crank chamber S4 may be minimized. Accordingly, since a sum of the moment of the swash plate 220 by the pressure of the crank chamber S4 and the moment by the return spring of the swash plate 220 (hereinafter, the first moment) is smaller than a moment by the compression reactive force of the piston 230 (hereinafter, the second moment), the inclination angle of the swash plate 220 may be maximized, the stroke of the piston 230 may be maximized, and the refrigerant discharge amount may be maximized.

Next, after the maximum mode, the amount of refrigerant flowing into the inflow path 430 from the discharge chamber S3 may be adjusted by the pressure control valve (not illustrated) according to the required refrigerant discharge amount such that the stroke of the piston 230 may be adjusted, the inclination angle of the swash plate 220 may be adjusted, and the refrigerant discharge amount may be adjusted.

That is, when reduction of the refrigerant discharge amount is required, an amount of a refrigerant flowing from the discharge chamber S3 to the inflow path 430 may be increased by the pressure control valve (not illustrated), and when the amount of a refrigerant flowing into the crank chamber S4 through the inflow path 430 is increased, the pressure in the crank chamber S4 may be increased, and the first moment may be increased. Also, as the first moment is greater than the second moment, the inclination angle of the swash plate 220 may be reduced, the stroke of the piston 230 may be reduced, and the refrigerant discharge amount may be reduced.

On the other hand, when increase of the refrigerant discharge amount is required, an amount of a refrigerant flowing from the discharge chamber S3 to the inflow path 430 is reduced by the pressure control valve (not illustrated), and when an amount of a refrigerant flowing into the crank chamber S4 through the inflow path 430 is reduced, the pressure in the crank chamber S4 may be reduced, and the first moment may be reduced. In addition, since the first moment gets smaller than the second moment, the inclination angle of the swash plate 220 may be increased, the stroke of the piston 230 may be increased, and the refrigerant discharge amount may be increased.

On the other hand, when the first moment and the second moment are the same, the inclination angle of the swash plate 220 may be maintained in a steady state, and the stroke of the piston 230 and the refrigerant discharge amount may be maintained constant.

Here, since the compression reactive force of the piston 230 is proportional to the compression amount, the compression reactive force and the second moment of the piston 230 increase accordingly as the inclination angle of the swash plate 220 increases. Accordingly, as the inclination angle of the swash plate 220 increases, the pressure in the crank chamber S4 for maintaining the inclination angle of the swash plate 220 also increases. That is, the pressure of the crank chamber S4 when the inclination angle of the swash plate 220 is relatively large but maintained in a steady state is required to be greater than the pressure of the crank chamber S4 when the inclination angle of the swash plate 220 is relatively small but maintained in a steady state.

On the other hand, in order to reduce the pressure of the crank chamber S4, an opening amount of the inflow path 430 should be reduced such that an amount of a refrigerant flowing into the crank chamber S4 from the discharge chamber S3 is reduced, and the refrigerant in the crank chamber S4 should be discharged to an outside of the crank chamber S4, and for this purpose, the discharge flow path 450 for guiding the refrigerant in the crank chamber S4 to the suction chamber S1 is provided.

Here, in the swash plate compressor according to the present embodiment, the discharge flow path control valve 460 for controlling the cross-sectional flow area of the discharge flow path 450 by the differential pressure $\Delta P$ between pressure of the crank chamber S4 and pressure of the suction chamber S1 is included such that a refrigerant passing through the discharge flow path 450 may be decompressed to prevent the pressure in the suction chamber S1 from increasing, the refrigerant discharge amount may be quickly adjusted, deterioration of compressor efficiency may be prevented and responsiveness at the initial stage of driving may be improved at the same time.

Specifically, referring to FIG. 2, when the differential pressure ΔP is equal to or less than the first pressure P1, force applied to the second pressure surface F2 is larger than force applied to the first pressure surface F1, and the valve core 467 may be moved toward the valve inlet 462. In addition, the first pressure surface F1 may come into contact with the first stepped surface 463. Accordingly, the refrigerant in the crank chamber S4 flows to the suction chamber S1 through the valve inlet 462, the first communication path 467*b* and the valve outlet 466, and at this time, the cross-sectional flow area of the discharge flow path 450 may be determined by the cross-sectional area of the first communication passage 467*b*. Here, since a cross-sectional area of the first communication path 467*b* is smaller than a cross-sectional area of the valve inlet 462 and a cross-sectional area of the valve outlet 466, a refrigerant passing through the discharge flow path 450 is decompressed, thereby increase of the pressure of the suction chamber S1 may be prevented. In addition, since a cross-sectional area of the first communication path 467*b* is smaller than the cross-sectional flow area of the conventional orifice hole H as shown in FIG. 7, an unnecessary leakage of the refrigerant in the crank chamber S4 into the suction chamber S1 may be constrained as illustrated in FIG. 8, and decrease in compressor efficiency due to a refrigerant leakage may be constrained. In addition, referring to FIG. 3, when the differential pressure ΔP is greater than the first pressure P1 and less than the second pressure P2, force applied to the first pressure surface F1 gets greater than the force applied to the second pressure surface F2 and the valve core 467 may be moved toward the valve outlet 466. In addition, the first pressure surface F1 may be spaced apart from the first stepped surface 463. Accordingly, a portion of the refrigerant in the crank chamber S4 flows to the suction chamber S1 through the valve inlet 462, the inlet portion 464*a*, the first communication path 467*b* and the valve outlet 466, and the remainder of the refrigerant in the crank chamber S4 flows to the suction chamber S1 through the valve inlet 462, the inlet portion 464*a*, the second communication path 467*d*, and the valve outlet 466 and in this case, the cross-sectional flow area of the discharge flow path 450 may be increased than that of the first communication path 467*b*. Here, since the cross-sectional flow area of the discharge flow path 450 is smaller than a cross-sectional area of the valve inlet 462 and a cross-sectional area of the valve outlet 466, a refrigerant passing through the discharge flow path 450 is decompressed, thereby the pressure rise of the suction chamber S1 can be prevented. Moreover, since the cross-sectional flow area of the discharge flow path 450 is greater than a cross-sectional flow area of the conventional orifice hole H as shown in FIG. 7, and as a refrigerant of the crank chamber S4 (including a liquid refrigerant) may be quickly discharged into the suction chamber S1 at times such as the initial stage of driving for example, time required for adjusting the inclination angle of the swash plate 220 and adjusting the refrigerant discharge amount may be reduced. That is, responsiveness may be improved. On the other hand, although the cross-sectional flow area of the discharge flow path 450 is greater than the cross-sectional flow area of the conventional orifice hole H, a refrigerant leakage amount is reduced compared to that of prior art by a flow distance and a flow resistance inside the discharge flow path control valve 460 as shown in FIG. 8, thereby a decrease in compressor efficiency due to a refrigerant leakage may be constrained. On the other hand, as the differential pressure ΔP increases within a range in which the differential pressure ΔP is greater than the first pressure P1 and less than the second pressure P2, the valve core 467 is moved further toward the valve outlet 466, and the effective cross-sectional area of the second communication path 467*d* is gradually reduced, such that the cross-sectional flow area of the discharge flow path 450 is gradually reduced, but may be still greater than the cross-sectional area of the first communication path 467*b*. Here, since the cross-sectional flow area of the discharge flow path 450 is smaller than a cross-sectional area of the valve inlet 462 and a cross-sectional area of the valve outlet 466, the refrigerant passing through the discharge flow path 450 is decompressed and pressure rise of the suction chamber S1 can be prevented. Further, since the cross-sectional flow area of the discharge flow path 450 may become smaller than the cross-sectional flow area of the conventional orifice hole H as illustrated in FIG. 7, when the differential pressure ΔP needs to be increased as illustrated in FIG. 8, the refrigerant leakage amount may be reduced, and accordingly, decrease in compressor efficiency due to a refrigerant leakage may be constrained.

In addition, referring to FIG. 4, when the differential pressure ΔP is equal to or greater than the second pressure P2, force applied to the first pressure surface F1 gets greater than force applied to the second pressure surface F2, thereby the valve core 467 may be moved further toward the valve outlet 466. In addition, the first pressure surface F1 may be further spaced apart from the first stepped surface 463. In addition, a front-end surface of the side plate 467*c* may be in contact with the third stepped surface 465, and the second communication path 467*d* may be completely covered and closed by the outlet portion 464*c*. Accordingly, the refrigerant in the crank chamber S4 passes through the valve inlet 462, the inlet portion 464*a*, the first communication path 467*b* and the valve outlet 466 to the suction chamber S1, and at this time, the cross-sectional flow area of the discharge flow path 450 may be determined again by the cross-sectional area of the first communication path 467*b*. Here, since the cross-sectional flow area of the discharge flow path 450 is smaller than a cross-sectional area of the valve inlet 462 and a cross-sectional area of the valve outlet 466, the refrigerant passing through the discharge flow path 450 is decompressed and pressure rise of the suction chamber S1 may be prevented. In addition, since the cross-sectional flow area of the discharge flow path 450 is smaller than the cross-sectional flow area of the conventional orifice hole H as illustrated in FIG. 7, the amount of refrigerant leakage is also reduced in a state in which the differential pressure ΔP is large as illustrated in FIG. 8, thereby a decrease in compressor efficiency due to a refrigerant leakage may be constrained.

Meanwhile, since the discharge flow control valve 460 has a simple structure, an increase range of a cost due to the discharge flow control valve 460 may be small.

In addition, since the discharge flow path 450 is prevented from being clogged by a liquid refrigerant, there is no need to separately provide a device for removing the liquid refrigerant, for example, a pressure control valve (not illustrated) and the like, and accordingly, a cost of the compressor may be reduced.

The invention claimed is:

1. A swash plate compressor comprising:

a housing;

a rotating shaft rotatably mounted to the housing;

a swash plate accommodated in a crank chamber of the housing and rotating together with the rotating shaft;

a piston forming a compression chamber together with the housing and interlocking with the swash plate to reciprocate;

a discharge flow path for guiding a refrigerant of the crank chamber to a suction chamber of the housing such that an inclination angle of the swash plate is adjusted; and a discharge flow path control valve having a valve chamber provided in the discharge flow path, a valve core reciprocating inside the valve chamber, a valve inlet through which the crank chamber communicates with the valve chamber, a valve outlet through which the suction chamber communicates with the valve chamber, and an elastic member for pressing the valve core toward the valve inlet, wherein the valve core comprises a first communication path for constantly communicating the discharge flow path and a second communication path for communicating the discharge flow path when a differential pressure between a pressure of the crank chamber and a pressure of the suction chamber is within a certain pressure range, wherein the housing comprises a cylinder block having a bore accommodating the piston therein, a front housing coupled to one side of the cylinder block and having the crank chamber, and a rear housing coupled to another side of the cylinder block and having the suction chamber, wherein a valve mechanism through which the suction chamber communicates with and shields the compression chamber is interposed between the cylinder block and the rear housing, wherein the rear housing comprises a post portion supported by the valve mechanism, wherein the valve inlet is formed in the valve mechanism, and wherein the valve outlet and the valve chamber are formed in the post portion.

2. A swash plate compressor comprising:

a housing;

a rotating shaft rotatably mounted to the housing;

a swash plate accommodated in a crank chamber of the housing and rotating together with the rotating shaft;

a piston forming a compression chamber together with the housing and interlocking with the swash plate to reciprocate;

a discharge flow path for guiding a refrigerant of the crank chamber to a suction chamber of the housing such that an inclination angle of the swash plate is adjusted; and a discharge flow path control valve having a valve chamber provided in the discharge flow path and a valve core reciprocating inside the valve chamber, wherein the valve core comprises a first communication path for constantly communicating the discharge flow path and a second communication path for communicating the discharge flow path when a differential pressure between a pressure of the crank chamber and a pressure of the suction chamber is within a certain pressure range, wherein the discharge flow path control valve is formed to adjust a cross-sectional flow area of the discharge flow path to be equal to a first area when the differential pressure is equal to or less than a first pressure or equal to or greater than a second pressure, and is formed to adjust the cross-sectional flow area of the discharge flow path to be greater than the first area when the differential pressure is greater than the first pressure and less than the second pressure.

3. The swash plate compressor of claim 2, wherein the discharge flow path control valve is formed to decrease the cross-sectional flow area of the discharge flow path accordingly, as the differential pressure increases within a range greater than the first pressure and smaller than the second pressure.

4. A swash plate compressor comprising:

a housing;

a rotating shaft rotatably mounted to the housing;

a swash plate accommodated in a crank chamber of the housing and rotating together with the rotating shaft;

a piston forming a compression chamber together with the housing and interlocking with the swash plate to reciprocate;

a discharge flow path for guiding a refrigerant of the crank chamber to a suction chamber of the housing such that an inclination angle of the swash plate is adjusted; and a discharge flow path control valve having a valve chamber provided in the discharge flow path, a valve core reciprocating inside the valve chamber, a valve inlet through which the crank chamber communicates with the valve chamber, a valve outlet through which the suction chamber communicates with the valve chamber, and an elastic member for pressing the valve core toward the valve inlet, wherein the valve core comprises a first communication path for constantly communicating the discharge flow path, a second communication path for communicating the discharge flow path when a differential pressure between a pressure of the crank chamber and a pressure of the suction chamber is within a certain pressure range, a base plate having a first pressure surface opposite to the valve inlet and a second pressure surface opposite to the valve outlet, and a side plate protruding annularly from an outer periphery of the second pressure surface, wherein the first communication path is formed through the base plate from the first pressure surface to the second pressure surface, and wherein the second communication path is formed through the side plate from an outer peripheral surface of the side plate to an inner peripheral surface of the side plate.

5. The swash plate compressor of claim 4, wherein the valve chamber comprises an inlet portion communicating with the valve inlet and an outlet portion communicating with the valve outlet, and wherein an inner diameter of the inlet portion is formed greater than an inner diameter of the outlet portion to form a second stepped surface between the inlet portion and the outlet portion.

6. The swash plate compressor of claim 5, wherein when a direction of a reciprocating motion of the valve core is an axial direction, and wherein the second communication path is formed to extend in the axial direction.

7. The swash plate compressor of claim 6, wherein in the second communication path, where a portion furthest apart in the axial direction from a front-end surface of the side plate is a starting portion of the second communication path, an axial distance between the front-end surface of the side plate and the starting portion of the second communication path is formed smaller than an axial length of the outlet portion, and an axial distance between the first pressure surface of the base plate and the starting portion of the second communication path is formed smaller than an axial length of the inlet portion.

8. The swash plate compressor of claim 7, wherein when the differential pressure is equal to or less than a first pressure, the first pressure surface is in contact with a first stepped surface, so that the refrigerant in the crank chamber is moved to the suction chamber through the valve inlet, the first communication path and the valve outlet, wherein when the differential pressure is greater than the first pressure and less than a second pressure, the first pressure surface is spaced apart from the first stepped surface, and at least a portion of the second communication path is opened by an inner peripheral surface of the inlet portion, so that the refrigerant in the crank chamber is moved to the suction chamber through the valve inlet, the inlet portion, the first communication path, the second communication path and the valve outlet; and wherein when the differential pressure is equal to or greater than the second pressure, the first pressure surface is spaced apart from the first stepped surface, and the second communication path is closed by an inner peripheral surface of the outlet portion, so that the refrigerant in the crank chamber is moved to the suction chamber through the valve inlet, the inlet portion, the first communication path and the valve outlet.

9. The swash plate compressor of claim 5, wherein an inner diameter of the valve inlet is formed smaller than an outer diameter of the valve core, so that a first stepped surface contactable with the first pressure surface is formed between the inlet portion and the valve inlet, and wherein an inner diameter of the valve outlet is formed smaller than the outer diameter of the valve core, so that a third stepped surface contactable with a front-end surface of the side plate is formed between the outlet portion and the valve outlet.

10. The swash plate compressor of claim 9, wherein the elastic member is formed as a coil spring having a first end supported by the second pressure surface and a second end supported by the third stepped surface.

11. The swash plate compressor of claim 9, wherein an inner diameter of the first communication path is formed smaller than the inner diameter of the valve inlet.

* * * * *